US007694656B2

(12) United States Patent
Thomas

(10) Patent No.: US 7,694,656 B2
(45) Date of Patent: Apr. 13, 2010

(54) CYLINDER HEAD FOR ROTARY VALVE INTERNAL COMBUSTION ENGINE

(75) Inventor: Andrew Donald Thomas, North Epping (AU)

(73) Assignee: Bishop Innovation Limited, North Ryde, New South Wales (AU)

( * ) Notice: Subject to any disclaimer, the term of this patent is extended or adjusted under 35 U.S.C. 154(b) by 674 days.

(21) Appl. No.: 11/659,725

(22) PCT Filed: Aug. 31, 2005

(86) PCT No.: PCT/AU2005/001312

§ 371 (c)(1),
(2), (4) Date: Feb. 8, 2007

(87) PCT Pub. No.: WO2006/024087

PCT Pub. Date: Mar. 9, 2006

(65) Prior Publication Data

US 2008/0072852 A1 Mar. 27, 2008

(30) Foreign Application Priority Data

Sep. 1, 2004 (AU) ..... 2004904985

(51) Int. Cl.
*F02F 1/36* (2006.01)
*F02B 75/20* (2006.01)
*F01L 7/00* (2006.01)

(52) U.S. Cl. ..... 123/41.82 R; 123/59.1; 123/80 BA; 123/190.4; 29/888.06

(58) Field of Classification Search ..... 123/41.72, 123/41.74, 41.82 R, 59.1–59.4, 80 R, 80 BA, 123/190.1–190.17; 29/888.06
See application file for complete search history.

(56) References Cited

U.S. PATENT DOCUMENTS

| | | | | |
|---|---|---|---|---|
| 4,404,939 | A * | 9/1983 | Kinzl et al. | 123/198 DB |
| 4,782,801 | A | 11/1988 | Ficht et al. | |
| 4,852,532 | A | 8/1989 | Bishop | |
| 4,949,685 | A | 8/1990 | Doland et al. | |
| 5,503,124 | A | 4/1996 | Wallis | |
| 6,321,699 | B1 | 11/2001 | Britton | |

FOREIGN PATENT DOCUMENTS

| | | |
|---|---|---|
| DE | 24 60 164 A1 | 6/1976 |
| DE | 35 42 061 A1 | 6/1987 |

* cited by examiner

*Primary Examiner*—Noah Kamen
(74) *Attorney, Agent, or Firm*—Birch, Stewart, Kolasch & Birch, LLP

(57) ABSTRACT

A cylinder head (3) for an axial flow rotary valve (1). The head comprises a bore (2) having an axis and adapted to house an axial flow rotary valve (1), a window (8) in the bore through which at least one port (12, 13) in the valve periodically communicates with a combustion chamber (9) as the valve rotates, at least two axially extending slots (21) in the bore, adjacent opposite sides of the window, each of the slots being adapted to locate a floating elongate gas sealing element (20), and at least one spark plug hole (7) adjacent to the bore and adapted for mounting a spark plug associated with the valve. The head further comprises at least one elongate axially extending cooling passage (24, 25 26) disposed between the bore and the spark plug hole, adjacent to one of the slots, the passage having a substantially constant cross section and extending axially at least over the length of the slots.

21 Claims, 12 Drawing Sheets

CYLINDER HEAD FOR ROTARY VALVE INTERNAL COMBUSTION ENGINE

TECHNICAL FIELD

The present invention relates to cooling internal combustion engines having a single axial flow rotary valve per cylinder and in particular to multi-cylinder inline versions of these engines.

BACKGROUND

The present invention relates to internal combustion engines having axial flow rotary valves incorporating an inlet and an exhaust port in the same valve. Each valve rotates with small clearance in a bore in the cylinder head of the engine. The ports terminate as openings in the periphery of the valve. During rotation, these openings periodically communicate with a similar window in the cylinder head allowing the passage of gas from the valve to the cylinder and vice versa. The clearance between the valve and the bore is sealed by an array of floating seals preferably having two elongate axial seals adjacent opposite sides of the window, each located in a slot in the cylinder head bore. For combustion efficiency and packaging reasons, the spark plugs are typically adjacent the cylinder head bores and the axial seal slots, and in the case of a multi-cylinder engine, the spark plugs are between the cylinder head bores of adjacent cylinders. Multi-cylinder inline engines with each cylinder having a single axial flow rotary valve are arranged with the axis of each valve substantially perpendicular to the crankshaft axis. U.S. Pat. No. 4,852,532 (Bishop) discloses an axial flow rotary valve engine having these features.

All internal combustion engines require cooling of the cylinders and cylinder heads. In water or liquid cooled engines, the engine is typically connected to a radiator through two pipes. A bottom pipe is generally connected to a water pump mounted on or in the engine that pumps coolant through the engine and out through a top pipe back into the radiator.

The cylinder heads and blocks of liquid cooled internal combustion engines are typically machined from castings. The cooling passages are formed during the casting process using cores. The process and techniques of casting cylinder heads and blocks with cooling passages formed by cores is well known. However, the layout of multi-cylinder axial flow rotary valve engines presents difficulties in cooling the head that cannot be overcome by providing cast cooling passages and the solutions applicable to other types of rotary valve are not suited to axial flow rotary valves.

In any engine it is essential to identify the areas that are subjected to the greatest heat load and to provide adequate cooling to these areas. Prior art methods of cooling axial flow rotary valve engines with an array of floating seals have not adequately identified and addressed all of the cooling requirements of this type of engine. In an axial flow rotary valve engine there are four sources of significant heat input to the cylinder head.

Firstly, there are the axial gas sealing elements. The axial seals are subjected to high heat loads from the hot combustion gases. These combustion gases provide the pressure to energise the axial seals in a similar manner to a piston ring by pressing them against the circumferentially outermost sides of the axial slots, remote from the window, and against the valve itself. Heat is also transferred to the axial seals from the hot outside diameter of the valve and the only heat path available to cool the seals is through the sides of the axial slots remote from the window. The axial seal temperature must be maintained at a sufficiently low level to ensure that the oil used to lubricate the surface of the valve does not carbonise.

Secondly, there is the area surrounding the nose of the spark plug. The nose of the spark plug is defined as that area of the spark plug extending from the spark plug gap to the spark plug seat. In conventional spark plugs this area is coincident with the threaded portion of the spark plug. The nose of the spark plug is exposed directly to the hottest part of the combustion chamber as this is where combustion commences and is thus subject to heat transfer from the hot combustion gases for the entire combustion period. In conventional poppet valve engines this high localised heat input adjacent the spark plug nose is handled by having generous cast cooling passages around the spark plug boss adjacent the threaded portion of the spark plug mounting hole.

Thirdly, there is the portion of the combustion chamber surface immediately surrounding the end of the spark plug that is exposed to the combustion chamber. Just as the spark plug receives a very high localised heat input due to its location at the point of first combustion so does that portion of the combustion chamber surface immediately surrounding the end of the spark plug nose. A typical axial flow rotary valve engine has a section of the combustion chamber surface that extends from the nose of the spark plug, up into the window, to the bore in the cylinder head, which has a very small volume contained behind it. This section of the combustion chamber has a very large surface area to volume ratio and will consequently see a very high heat input and high temperature rises. This problem is compounded by the fact that this volume is located a long distance from any cooling passages in previous designs such as that shown in U.S. Pat. No. 4,852,532 (Bishop).

Finally, there are the circumferentially innermost surfaces and the floors of axial slots, which are exposed to the hot combustion gases that are used to energise the axial sealing elements. These surfaces put heat into the same small volume described above in relation to the third source of heat. This further increases the surface area to volume ratio of that portion of the head contained between the combustion chamber surface, the axial slot and the spark plug.

These four heat sources converge in the area contained between the spark plug, the bore in the cylinder head, the window and the combustion chamber. As a result this area is subject to very high localised heat loads and this area is the most heavily heat stressed area in any rotary valve assembly of this type. Furthermore, in an inline multi-cylinder axial flow rotary valve engine there is no room to accommodate a cast cooling passage around the spark plugs and it is difficult to arrange a flow of water past the spark plug.

Adequate cooling of this area is critical for two reasons. Firstly as discussed above, the axial seal temperature must be kept at a level below that required to carbonise the lubricating oil on the surface of the seal. Secondly, the very high temperatures generated in this area when they are not adequately cooled causes localised buckling pushing the cylinder head and axial seals radially inwards towards the rotary valve with consequent seizing of the rotary valve in the cylinder head.

Rotary valve designs to date have either failed to address this problem, as evidenced by the engines disclosed in U.S. Pat. No. 4,852,532 (Bishop) and U.S. Pat. No. 4,782,801 (Ficht et al), or have chosen less optimum rotary valve arrangements that allow the spark plug to be located well away from the bore and the seal slots, such as disclosed in U.S. Pat. No. 6,321,699 (Britton). In the former case, the designs have supplied cooling water to those areas least in need of cooling and have failed to provide cooling in those areas where cooling is critical.

The engine disclosed in U.S. Pat. No. 4,852,532 (Bishop) has cooling that is typical of the prior art and it illustrates the problems associated with cooling the cylinder head of an axial flow rotary valve engine using cast cooling passages. The cooling passages in the head are cast in a similar manner to those of a typical poppet valve engine. A water jacket is also cast into the cylinder block, surrounding the cylinders. The coolant is delivered to one end of the water jacket and passes through the water jacket from one end of the engine to the other. As coolant passes through the water jacket, it is bled off into the cast cooling passages in the head through holes in the bottom of the head. The coolant then flows through the cast cooling passages between the rotary valves to the top of the head where it then flows to a single collection point. Generally, the coolant is returned to the same end of the engine as it was delivered.

In this arrangement, the coolant flow in the cylinder head to the collection point travels through cast cooling passages in the cylinder head located above the rotary valves. This has the disadvantage that these passages above the rotary valves must be of sufficient cross section to ensure that the entire engine coolant flow can pass through it without excessive pressure drop. As the maximum coolant flow rates are high, the flow area will need to be large which adds considerably to the height of the engine. Furthermore the total volume of coolant in the cooling system is larger than would otherwise be necessary. The total volume of coolant is an important issue as it determines how fast an engine reaches operating temperature from a cold start which in turn has a direct effect on exhaust emissions.

The unique difficulties of cooling axial flow rotary valve engines having a single rotary valve per cylinder compared to poppet valve engines and other types of rotary valve relate to the large diameter of the axial flow rotary valves (typically up to 75% of the cylinder bore size) and close cylinder bore spacing of modern engines leaving little room between adjacent rotary valves for cast cooling passages. Furthermore, the spark plugs must be accommodated in the limited spaces between the valves, and in order to position the spark plugs as close to the centre of the cylinder as possible, they must be positioned as close as possible to the cylinder head bores and the axial seal slots. This leaves insufficient room to cast a cooling passage between each cylinder head bore its associated spark plug. This is illustrated by FIG. 7 of U.S. Pat. No. 4,852,532 (Bishop) where there are no cooling passages between each cylinder head bore and its associated spark plug. At best, the cast cooling passages only cool approximately half the periphery of each spark plug mounting hole. Furthermore the portion of the periphery that can be cooled is subject to a much smaller heat load than the portion that cannot be cooled.

The area surrounding the axial seal slot adjacent the spark plug mounting hole is the hottest region in the cylinder head and the engine disclosed in U.S. Pat. No. 4,852,532 (Bishop) does not have any cooling in this area. Providing cast cooling passages that extend into these regions is impractical.

The problems with using cast cooling passages to cool an axial flow rotary valve engine are exacerbated by the holes connecting the cast cooling passages in the head with the cylinder block water jacket being constrained by geometry considerations to lie some distance from the centre line of the cylinders, and hence some distance from the spark plugs. The flow through these holes directs coolant towards the top of the head, rather than towards the spark plugs, and consequently the spark plugs are located in a stagnant area where there is relatively little coolant movement. This problem is further exacerbated if the holes feeding coolant to the head are located on both sides of the spark plugs, in which case coolant is fed towards the spark plugs from both sides preventing a strong flow of coolant past the spark plugs. This problem can be partially addressed by fitting baffles in the cast passages above the holes feeding coolant to the head. These baffles direct coolant flow towards the spark plugs. However, they dramatically increase the complexity of the cylinder head assembly and require access to the cast cooling passages for fitment.

The problem of cooling an axial flow rotary valve engine using cast cooling passages is made even more difficult in the case of engines having two spark plugs per cylinder. In these designs the rotary valve is typically positioned in the centre of the cylinder and the spark plugs are located on either side of the valve. This means that in a multi-cylinder engine there are two adjacent spark plugs between each pair of rotary valves, further limiting the available space around the spark plug bosses for cast cooling passages.

Other types of rotary valve, such as radial flow valves and valves having cut-outs in their periphery, can be arranged in multi-cylinder engines with their valve axis parallel to the crankshaft axis. These types of rotary valve have the advantage of simpler drive arrangement and cooling requirements compared with axial flow rotary valves but their performance is inferior. These types of valve are typically formed in one or two shafts, each extending the length of a multi-cylinder inline engine. In this case, the cast cooling passages can simply be arranged to surround the valve and extend from one end of the engine to the other in close proximity to the outside diameter of the valve, which is not possible in an axial flow rotary valve having its axis perpendicular to the crankshaft.

Rotary valve arrangements having the valve formed as a single shaft extending the length of the engine parallel to the crankshaft generally have their spark plugs placed under the valve near the periphery of the cylinder, pointing towards the side of the engine. This spark plug location is possible because, unlike a multi-cylinder axial flow rotary valve engine, there is no adjacent rotary valve to interfere with. Typical examples of this arrangement are disclosed in DE 2460164 A1 (Volkswagenwerk AG) and U.S. Pat. No. 6,321,699 (Britton). This arrangement has the advantage that the spark plugs are remote from the valve leaving ample room for generous cooling passages between the valve and the spark plugs. However, it is well known that a spark plug located adjacent the cylinder wall results in poor combustion performance.

Rotary valve arrangements having the valves formed in two shafts extending the length of the engine overcome this issue by placing the spark plug between the valves at or near the cylinder centre, which is the optimum position from a combustion perspective. A typical example of this arrangement is shown in U.S. Pat. No. 4,949,685 (Doland et al). In this type of arrangement, the axis of the valves is generally well outside the cylinder leaving ample room to cast cooling passages between the valves and the spark plug. However, this type of arrangement has the obvious disadvantage of requiring two valves instead of one.

The present invention seeks to provide a cooling system for axial flow rotary valve engines that ameliorates one or more of the disadvantages associated with the prior art.

SUMMARY OF INVENTION

In a first aspect, the present invention consists of a cylinder head for an axial flow rotary valve engine, said head comprising a bore having an axis and adapted to house an axial flow rotary valve, a window in said bore through which at least one port in said valve periodically communicates with a combustion chamber as said valve rotates, at least two axially extending slots in said bore, adjacent opposite sides of said window, each of said slots being adapted to locate a floating elongate gas sealing element, and at least one spark plug hole adjacent to said bore and adapted for mounting a spark plug associated with said valve, characterised in that said head further comprises at least one elongate axially extending cooling passage disposed between said bore and said spark plug hole, adjacent to one of said slots, said passage having a substantially constant cross section and extending axially at least over the length of said slots.

Preferably said at least one passage comprises a plurality of passages surrounding each of said slots. Preferably said passage is circumferentially disposed between one of said slots and the adjacent side of said window Preferably said cylinder head is manufactured from a casting and said passage is manufactured by a subsequent machining process. Preferably said casting does not include any cast cooling passages. In one preferred embodiment said machining process comprises drilling. In another preferred embodiment said machining process comprises electro-discharge machining. Preferably said cylinder head is integral with a cylinder liner.

Preferably said passage has a substantially circular cross section.

In a second aspect, the present invention consists of a method of manufacturing a cylinder head for an axial flow rotary valve engine, said head comprising a bore having an axis and adapted to house an axial flow rotary valve, a window in said bore through which at least one port in said valve periodically communicates with a combustion chamber as said valve rotates, at least two axially extending slots in said bore, adjacent opposite sides of said window, each said slot being adapted to locate a floating elongate gas sealing element, and at least one spark plug hole adjacent to said bore and adapted for mounting a spark plug associated with said valve, characterised in that said cylinder head is manufactured from a casting and said method comprises machining at least one elongate axially extending cooling passage in said head, said passage being disposed between said bore and said spark plug hole, adjacent to one of said slots, said passage having a substantially constant cross section and extending axially at least over the length of said slots.

Preferably said casting does not include any cast cooling passages. In one preferred embodiment said machining process comprises drilling. In another preferred embodiment said machining process comprises electro-discharge machining. Preferably said head is integral with a cylinder liner.

In a third aspect, the present invention consists of an axial flow rotary valve engine comprising at least one cylinder, a cylinder head, an axial flow rotary valve associated with each cylinder rotatable within a bore in said cylinder head about an axis, said axial flow rotary valve having an inlet port and an exhaust port periodically communicating with a combustion chamber through a window in said bore as said valve rotates, at least two axially extending slots in said bore, adjacent opposite sides of said window, each said slot housing a floating elongate gas sealing element, and at least one spark plug associated with said valve, each spark plug being mounted in a corresponding spark plug hole adjacent to said bore, characterised in that said head further comprises at least one elongate axially extending cooling passage disposed between said bore and said spark plug hole, adjacent to one of said slots, said passage having a substantially constant cross section and extending axially at least over the length of said slots, one end of said passage communicating with a high pressure cooling channel and the other end communicating with a low pressure cooling channel.

Preferably said cylinder and said cooling channels are formed in a cylinder block, said high and low pressure channels being separated by flow restrictions in said cylinder block.

Preferably said cylinder is formed in a cylinder liner that is integral with said cylinder head, and a cylinder block surrounds said cylinder liner, said cooling channels being formed by the clearances between said cylinder liner and said cylinder block, said high and low pressure cooling channels being separated by flow restrictions in said cylinder block.

Preferably said engine further comprises a crankshaft and said at least one cylinder comprises at least two inline cylinders, the axis of each said axial flow rotary valve being substantially perpendicular to the axis of said crankshaft, said high pressure cooling channel being disposed on one side of said cylinders and said low pressure cooling channel being disposed on the opposite side of said cylinders.

Preferably said at least one passage comprises a plurality of passages on each side of said window, surrounding said slots. Preferably said passage is circumferentially disposed between one of said slots and the adjacent side of said window.

Preferably said at least one spark plug comprises two spark plugs adjacent opposite sides of said bore.

BEST MODE OF CARRYING OUT THE INVENTION

Figure 1:
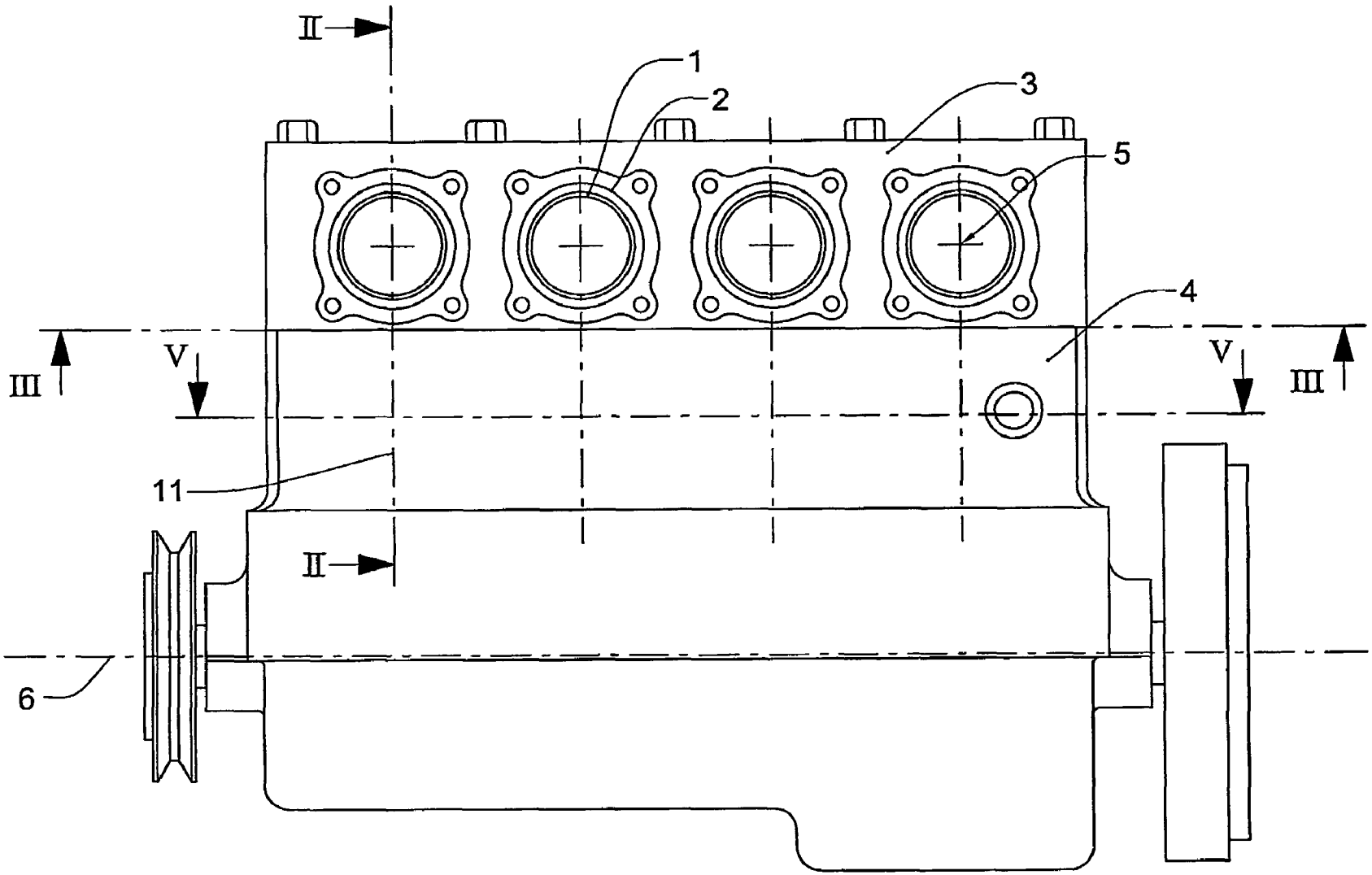
FIG. 1 is a side view of an axial flow rotary valve engine incorporating a first embodiment of the present invention.

FIGS. 1 to 5 show an axial flow rotary valve engine incorporating a first embodiment of the present invention. The engine has four inline cylinders 10, each having an axis 11. Each cylinder 10 has a single axial flow rotary valve 1. Each rotary valve 1 rotates about an axis 5 with small clearance within a bore 2 in cylinder head 3 The axes 5 of rotary valves 1 are perpendicular to the axis 6 of the engine crankshaft. Rotary valves 1 are driven in timed relationship with the engine crankshaft. Cylinder head 3 is bolted to cylinder block 4.

Figure 2:
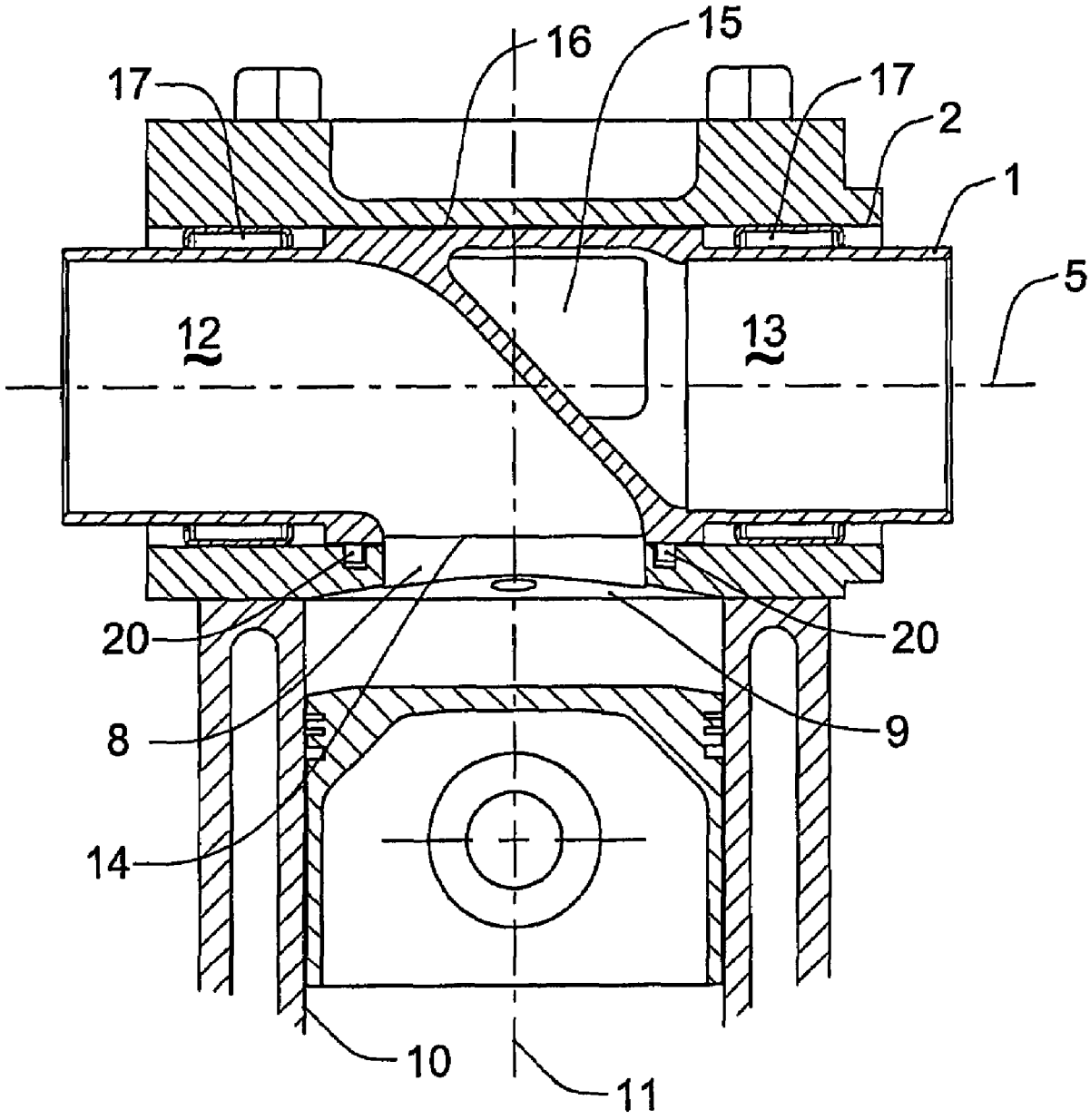
FIG. 2 is a sectional view along II-II of a rotary valve assembly of the engine shown in FIG. 1.

Referring to FIG. 2, each rotary valve 1 has a centre cylindrical portion 16 and is supported for rotation by bearings 17. Rotary valve 1 has an inlet port 12 and an exhaust port 13 terminating respectively at an inlet opening 14 and an exhaust opening 15 in cylindrical portion 16. Inlet port 12 and exhaust port 13 periodically communicate with combustion chamber 9 through a window 8 in cylinder head bore 2 as valve 1 rotates.

Figure 4:
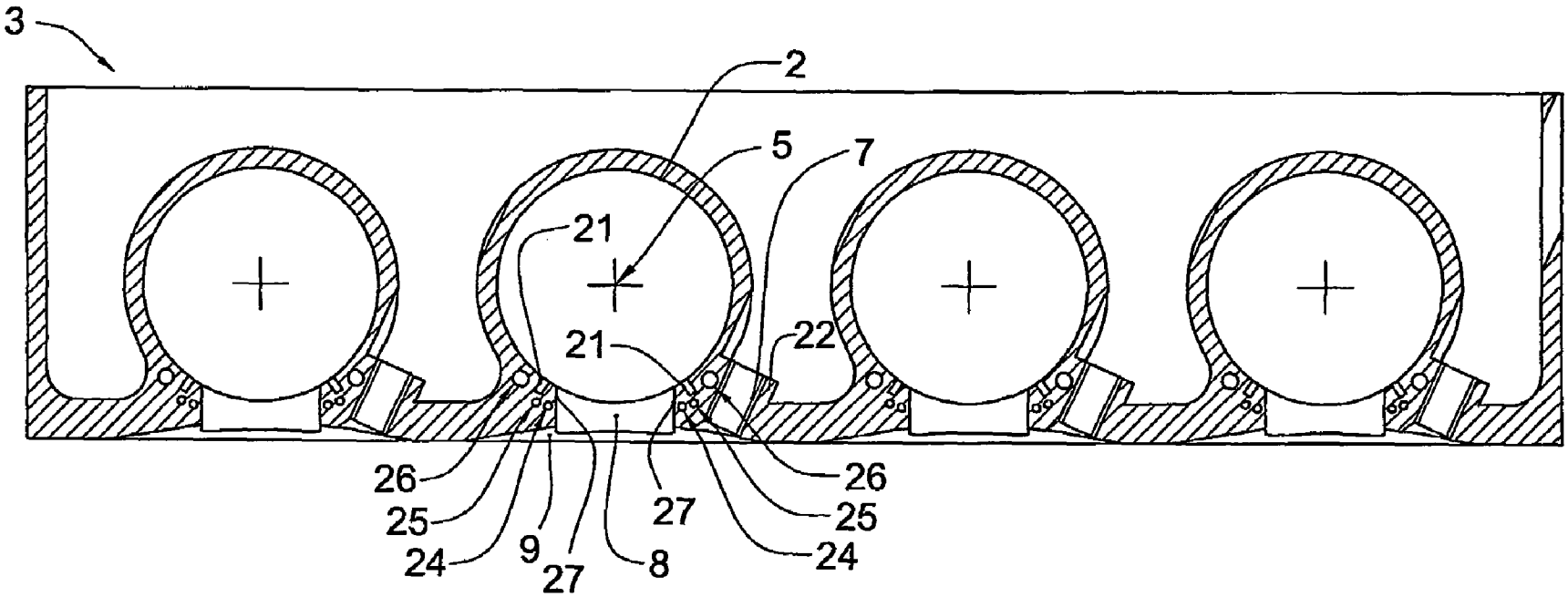
FIG. 4 is a sectional view along IV-IV of the cylinder head shown in FIG. 3.

Rotary valve 1 is sealed by an array of floating sealing elements 20 located in slots in cylinder head bore 2 and preloaded against cylindrical portion 16. The array of floating seals 20 includes two axial sealing elements (not shown) located in axially extending slots 21 in cylinder head bore 2, as shown in FIG. 4. Axial slots 21 are disposed adjacent opposite sides of window 8.

Referring to the cross section of cylinder head 3 shown in FIG. 4, each valve 1 has an associated spark plug (not shown) mounted in a threaded spark plug hole 7 adjacent to cylinder head bore 2, machined into spark plug boss 22 of cylinder head 3. Spark plug hole 7 is located is located near cylinder head bore 2 and the axial slot 21 on the same side of rotary valve 1 as spark plug hole 7 so that the nose of the spark plug is as close as possible to the centre of the cylinder.

Three elongate axially extending cooling passages 24, 25 and 26 are located on each side of window 8. Cooling passages 24, 25 and 26 are arranged adjacent to and surrounding axial slots 21. Cooling passages 24 closest to window 8 are disposed between axial slots 21 and the adjacent sides 27 of window 8. The group of cooling passages 24, 25 and 26 on the same side of window 8 as spark plug hole 7 are disposed circumferentially between cylinder head bore 2 and spark plug hole 7. Cooling passages 24, 25 and 26 are parallel to axis 5 and have a constant cross section. Coolant is pumped through cooling passages 24, 25 and 26 providing local cooling of the areas around axial slots 21, spark plug hole 7 and the sides of window 8. Cooling passages 26 are specifically located to cool the circumferentially outer side faces of axial slots 21 to control the temperature of the axial seals. Cooling passages 24 and 25 are specifically located to accommodate the heat flow from the combustion chamber surfaces and from the floor and circumferentially innermost sides of axial slots 21 to prevent excessive distortion of this area of cylinder head 3.

Figure 3:
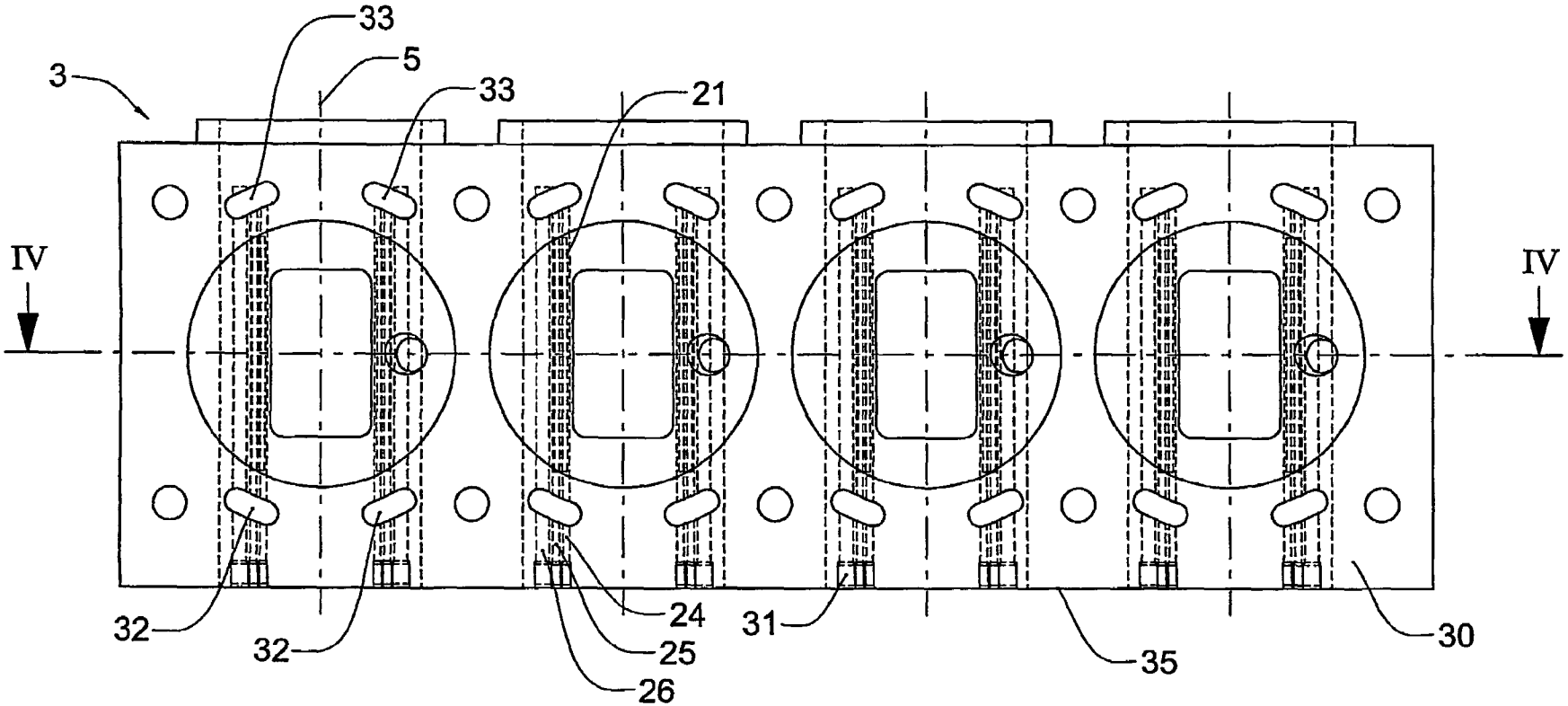
FIG. 3 shows the cylinder head of the engine shown in FIG. 1 viewed from III-III.

FIG. 3 is a view of cylinder head 3 looking at its fireface 30. Cooling passages 24, 25 and 26 are blind ended holes machined from side 35 of cylinder head 3 and extending past axial slots 21. Cooling passages 24, 25 and 26 are preferably manufactured by drilling but may be made by other machining processes such as electro-discharge machining. Cooling passages 24, 25 and 26 are blind ended at side 35 of cylinder 3 by plugs 31. Feed slots 32 and exit slots 33 in fireface 30 communicate with opposite ends of cooling passages 24, 25 and 26. Cylinder head 3 is preferably finish machined from a casting and it does not have any cast cooling passages.

Figure 5:
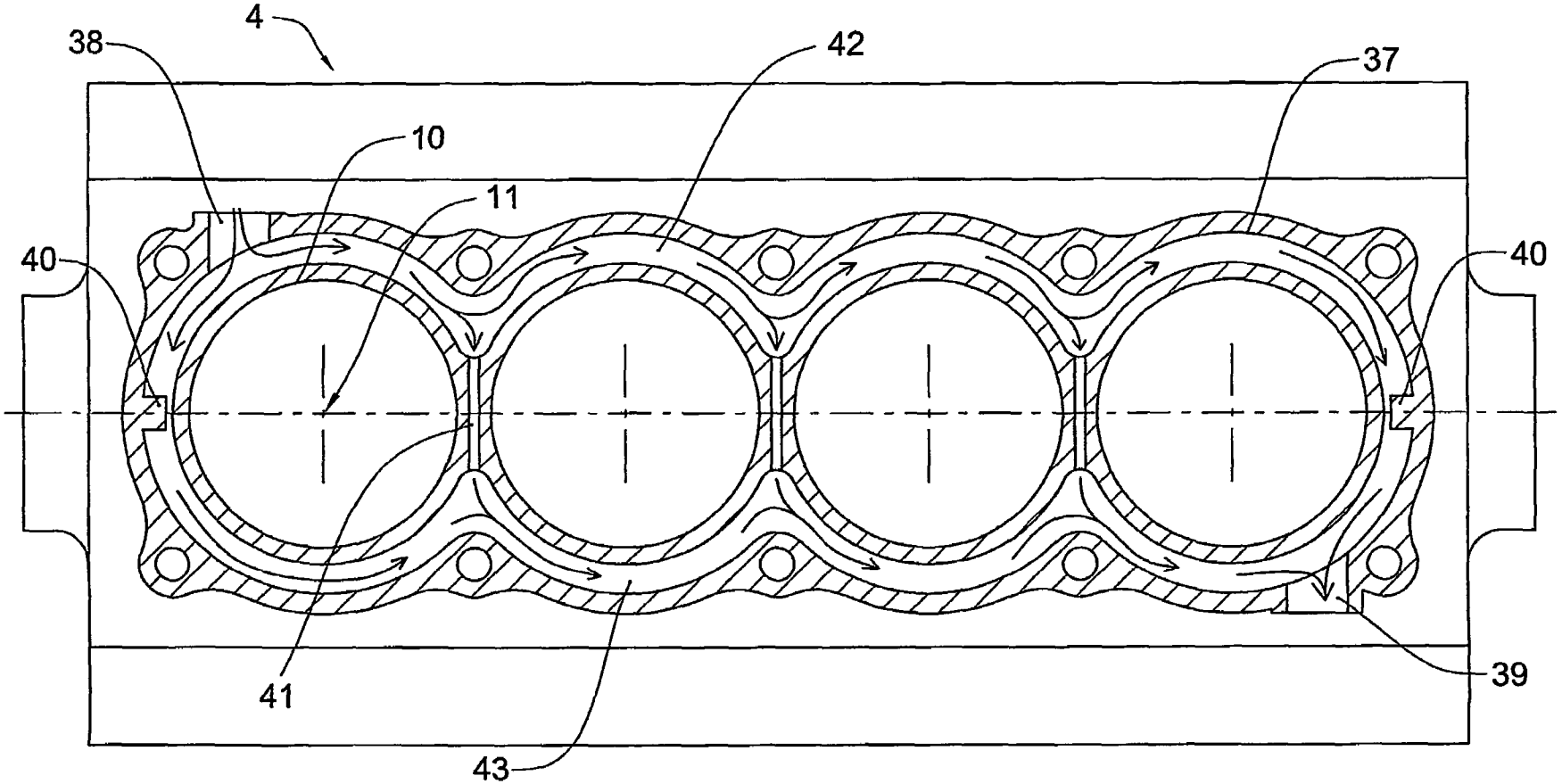
FIG. 5 is a sectional view along V-V of the cylinder block of the engine shown in FIG. 1.

Referring to FIG. 5, cylinder block 4 has a cast water jacket 37 surrounding cylinders 10. Water jacket 37 comprises a high pressure cooling channel 42 on one side of cylinders 10, and a low pressure channel 43 on the other side of cylinders 10. Coolant is fed into high pressure cooling channel 42 through inlet hole 38, and returns from low pressure cooling channel 43 to a radiator through exit hole 39. Coolant flow is unobstructed along the length of cylinder block 4 and the pressure differential between channels 42 and 43 is created by restricting the flow through water jacket 37 from one side of cylinder block 4 to the other. This restriction comprises the relatively small flow channels 41 between adjacent cylinders and restrictor blocks 40 at either end of cylinder block 4.

Feed slots 32 in cylinder head 3 communicate with high pressure cooling channel 42 in cylinder block 4, and exit slots 33 communicate with low pressure cooling channel 42. The pressure differential between feed slots 32 and exit slots 33 forces coolant to flow through cooling passages 24, 25 and 26.

Figure 6:
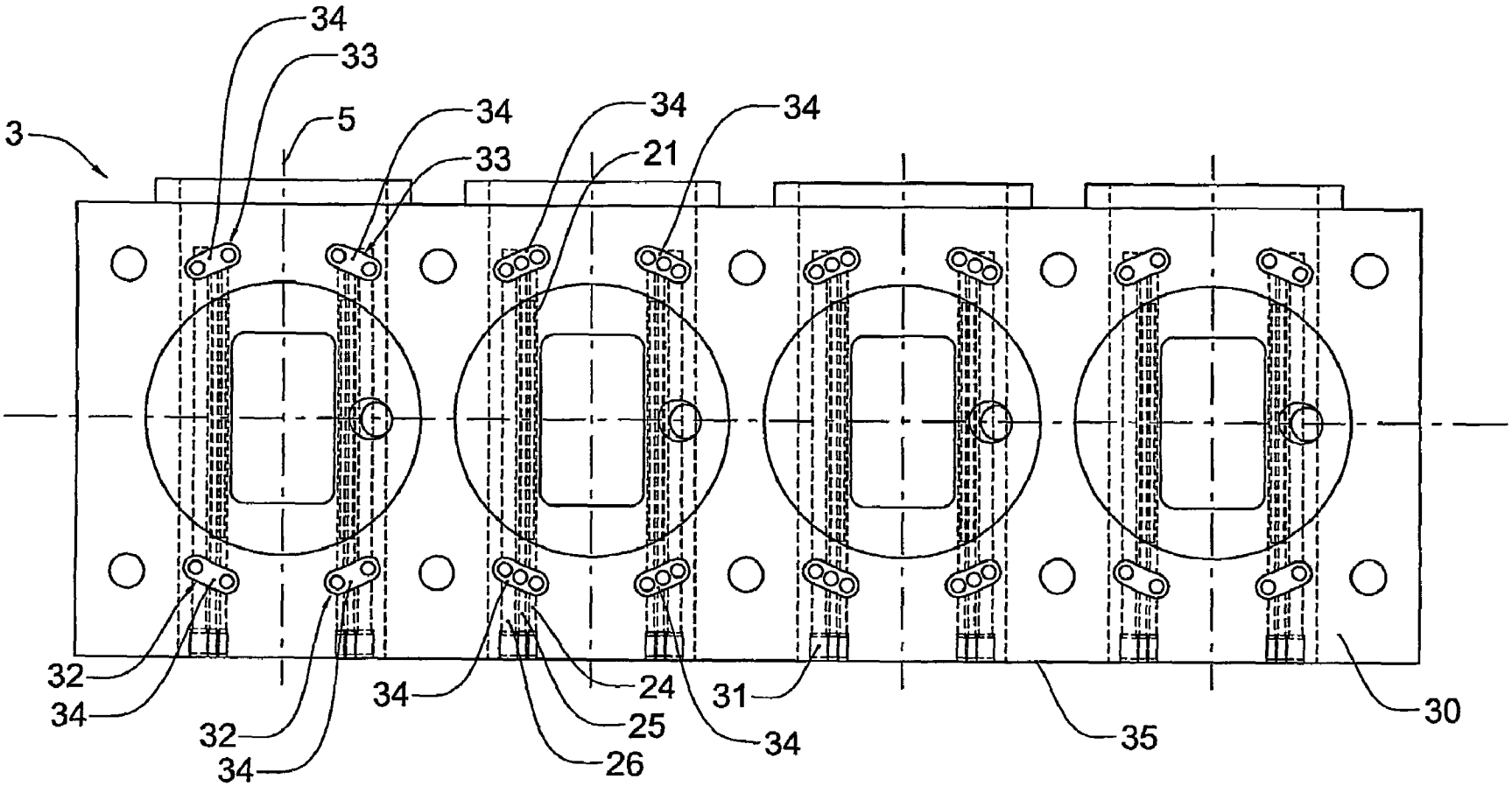
FIG. 6 shows the cylinder head of FIG. 3 fitted with restrictors in the entry slots.

FIG. 6 shows cylinder head 3 fitted with optional restrictors 34 in feed slots 32 and exit slots 33. As the pressure in cooling channels 42 and 43 may vary along the length of the engine, restrictors 34 have varying flow area to ensure that the flow through each group of cooling passages 24, 25 and 26 is substantially the same. In other not shown embodiments restrictors 34 may be fitted in only the feed slots 32 or only the exit slots 33.

The cooling arrangement of the engine shown in FIGS. 1 to 5 has many advantages over the prior art. Firstly, the cylinder head can be cast without using cores that are necessary to form cast cooling passages. Instead, cooling passages 24, 25 and 26 can be machined into the casting at the same time as the other features of the head are machined, which is a major simplification of the manufacturing process.

Furthermore, the elimination of cast cooling passages means that choosing a casting process in which cores are possible, such as sand casting, is not necessary and more economic casting processes such as die casting can be used. Machining the cooling passages has the advantage that the passages can have a small cross section and can be located close to other machined surfaces, such as cylinder head bore 2, spark plug mounting hole 7 and axial slots 21. The close proximity of the passages to the surface means that a smaller temperature gradient is required to drive the same heat flow. The small cross section means that the flow velocity is high and hence the Reynolds Number is high, which aids in efficient heat transfer to the coolant.

Secondly, as there are no cast cooling passages extending around the valve there is no need to provide exterior walls in the head casting to close off these passages, which results in a considerable reduction in the weight of the cylinder head.

Thirdly, only those areas of the cylinder head requiring cooling are actually cooled, which minimises the volume of coolant in the head. Cooling passages 24, 25 and 26 specifically cool the areas of cylinder head 3 that are subject to the highest heat load, as discussed in the background. This is in contrast to conventional cylinder heads having cast cooling passages where the design of these cast passages is dictated by the practical requirements of providing sand cores. For example, the cast passages need to be continuous and of sufficient section to ensure that the sand core can withstand the loads incurred during handling and the casting process itself. These requirements have little to do with the requirements of cooling the cylinder head and as such areas of the head are cooled where it is not required.

Equally as important as identifying which areas require cooling is identifying those areas that do not require cooling as this then allows the removal of unnecessary water passages and the cost and weight penalty of providing them. In this invention all cooling of the rotary valve is achieved by means of machined passages running parallel to the axis of the valve and located in the area between the centre line of the valve and the fireface. There are no passages required close to the circumferential seals which span between the axial seals at either end of the window and together form the seal array that seals the combustion gases in the cylinder. This is different than the cooling system disclosed in U.S. Pat. No. 6,321,699 (Britton) where cooling behind the seals extends around the entire seal pack. In the present invention, cooling behind the circumferential seals is not required primarily because the circumferential seals are located some considerable distance from the spark plug. As the combustion progresses across the combustion chamber it compresses the unburnt mixture ahead of the flame front. It is this unburnt and much cooler mixture that is pushed into the circumferential seal slot. The lower gas temperature means there is less heat load to shed. Furthermore, as the circumferential seals are remote from the spark plug there is no heat load from this source and the length of time that the adjacent combustion chamber surfaces are engulfed in flame is very much smaller than the areas immediately adjacent the spark plug.

Finally, the cooling system of the engine shown in FIGS. 1 to 5 has the additional major advantage that despite the fact there are no cast cooling passages in the cylinder head for the general transportation of coolant there is no requirement for additional galleries to perform this function. All coolant is transported through the engine using only those passages that are necessary for their cooling function. This completely eliminates the requirement for any cast cooling passages in the cylinder head resulting in a very low light casting.

In other not shown embodiments of the present invention, adequate cooling may be provided by other than three cooling passages on each side of the window depending on the demands of the particular engine. For example, in some lightly loaded applications sufficient cooling may be provided by a single passage on each side of the window, preferably in a similar location to passages 26. It should also be noted that it is not essential for cooling passages 24, 25 and 26 to be strictly parallel with axis 5, although it is preferable. In certain circumstances there may be a requirement to machine these passages slightly off parallel to avoid other features in the cylinder head. However, such an arrangement can only be used where the passages are drilled from both sides of the cylinder head.

Figure 7:
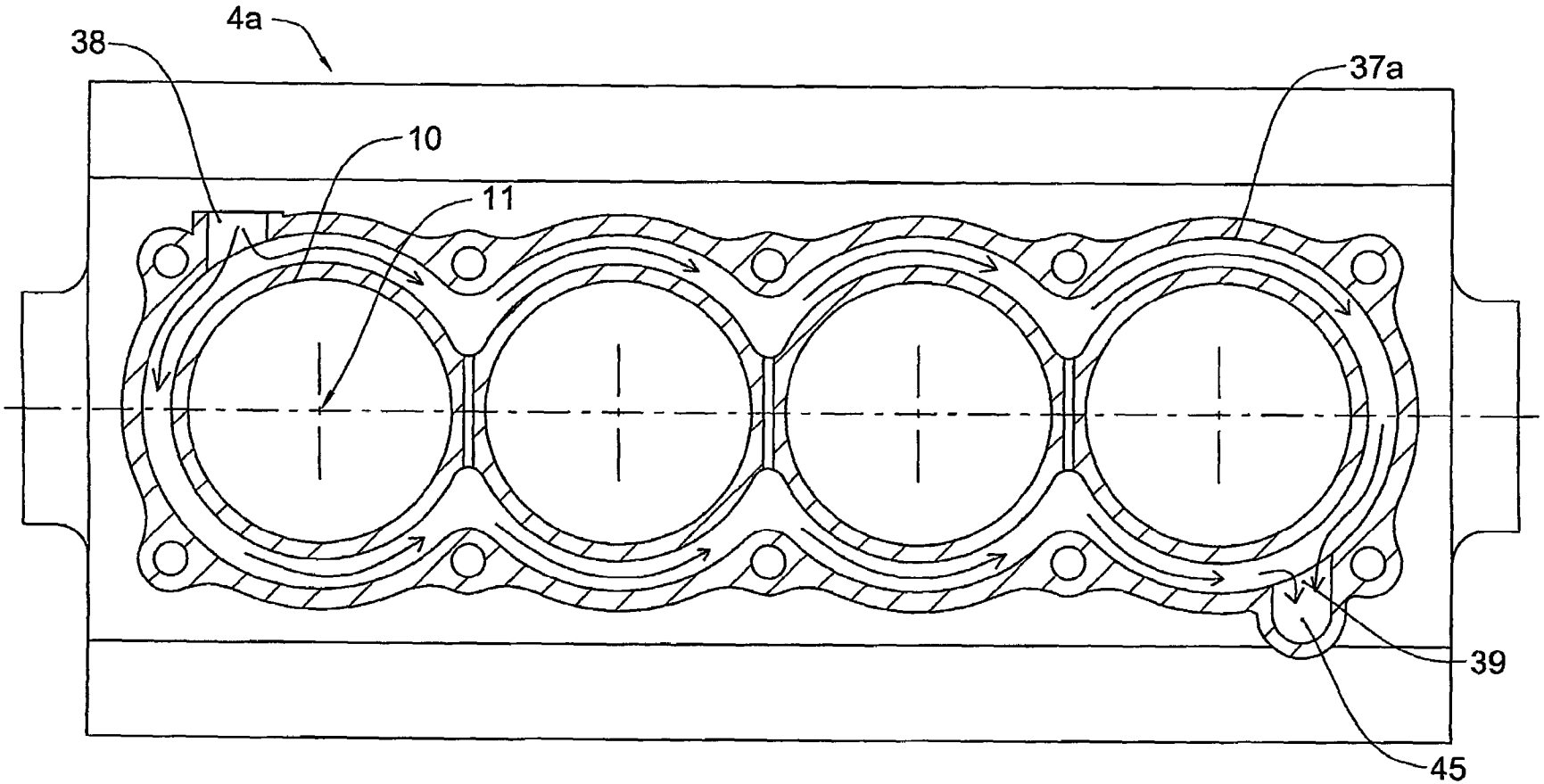
FIG. 7 is a sectional view through the cylinder block of an axial flow rotary valve engine incorporating a second embodiment of the present invention, viewed in the same manner as FIG. 5.
Figure 8:
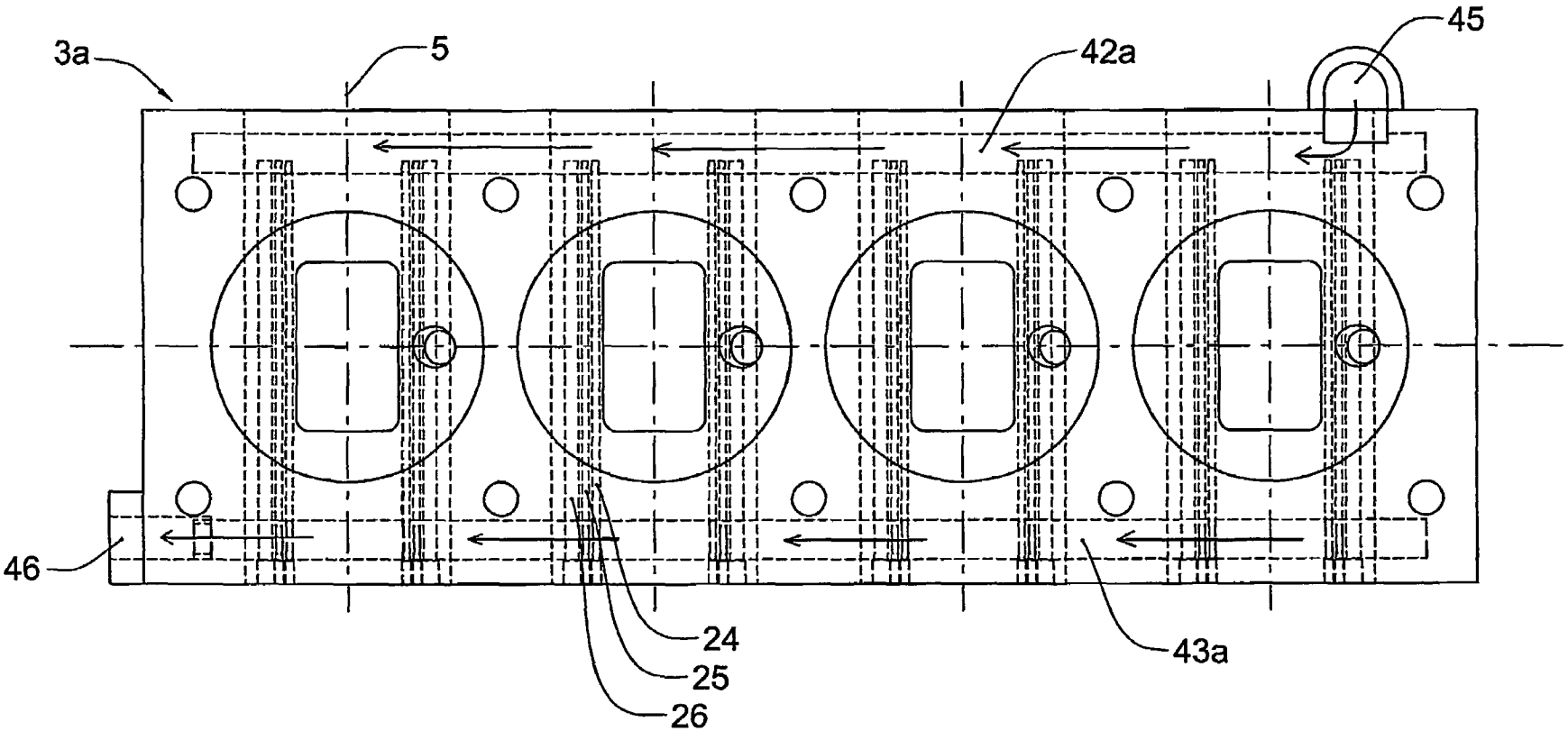
FIG. 8 shows the cylinder head of the engine of FIG. 7 viewed in the same manner as FIG. 3.

FIGS. 7 and 8 show an axial flow rotary valve engine incorporating a second embodiment of the present invention. Coolant enters the cast water jacket 37*a* of cylinder block 4*a* through inlet hole 38. Coolant then flows on both sides of cylinders 10 to the other end of cylinder block 4*a* where it then exits through hole 39. Unlike the engine shown in FIGS. 1 to 5, the coolant does not bleed off into cylinder head 3*a* as it flows through cylinder block 4*a*, and the coolant pressure is the same on both sides of cylinders 10. Coolant then flows through passage 45 to high pressure cooling channel 42*a* on one side of cylinder head 3*a*. High pressure cooling channel 42*a* forces coolant through cooling passages 24, 25 and 26 and into low pressure cooling channel 43*a* on the other side of cylinder head 3*a* in the same manner as the engine shown in FIGS. 1 to 5. Coolant then returns to a radiator through hole 46.

Figure 9:
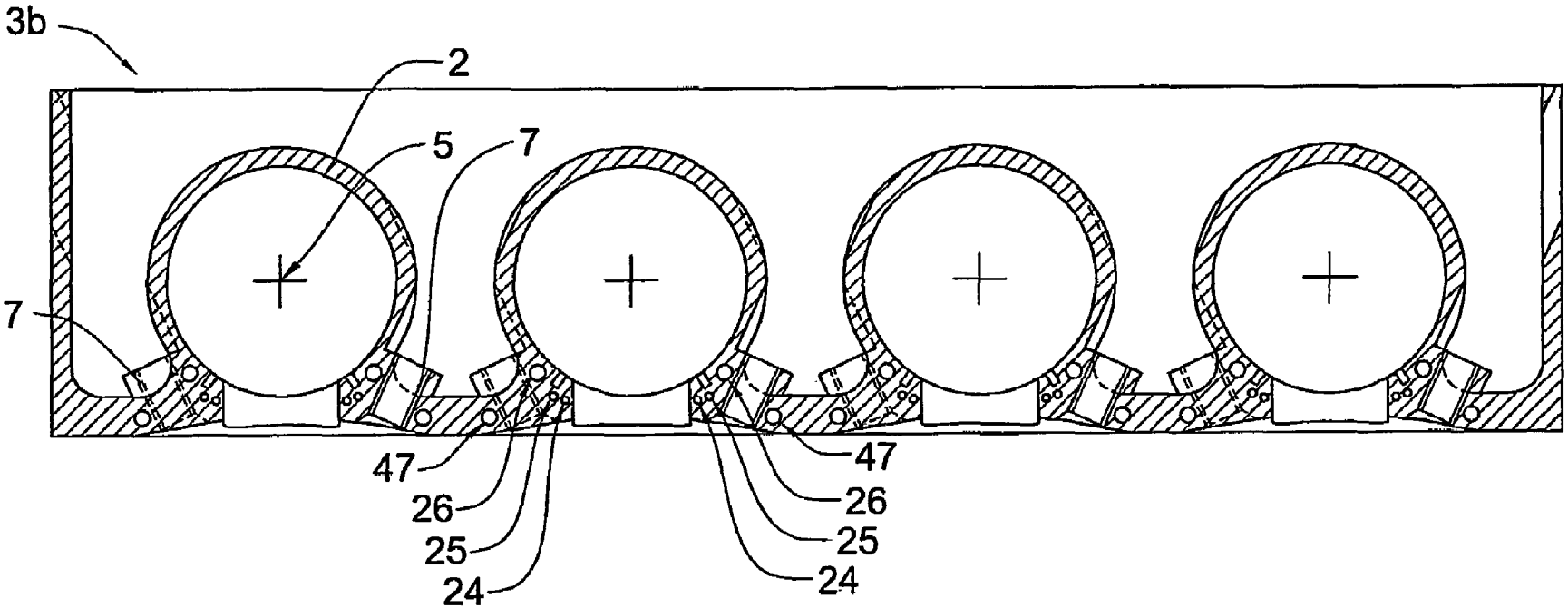
FIG. 9 is a sectional view through the cylinder head of an axial flow rotary valve engine incorporating a third embodiment of the present invention, viewed in the same manner as FIG. 4.

FIG. 9 is a sectional view through the cylinder head of an axial flow rotary valve engine incorporating a third embodiment of the present invention. This engine is the same as that shown in FIGS. 1 to 5 except each cylinder has two spark plugs (not shown) adjacent opposite sides its associated cylinder head bore 2, each spark plug being fitted in a spark plug mounting hole 7. Additional cooling is provided by passages 47, parallel to passages 24, 25 and 26.

Figure 10:
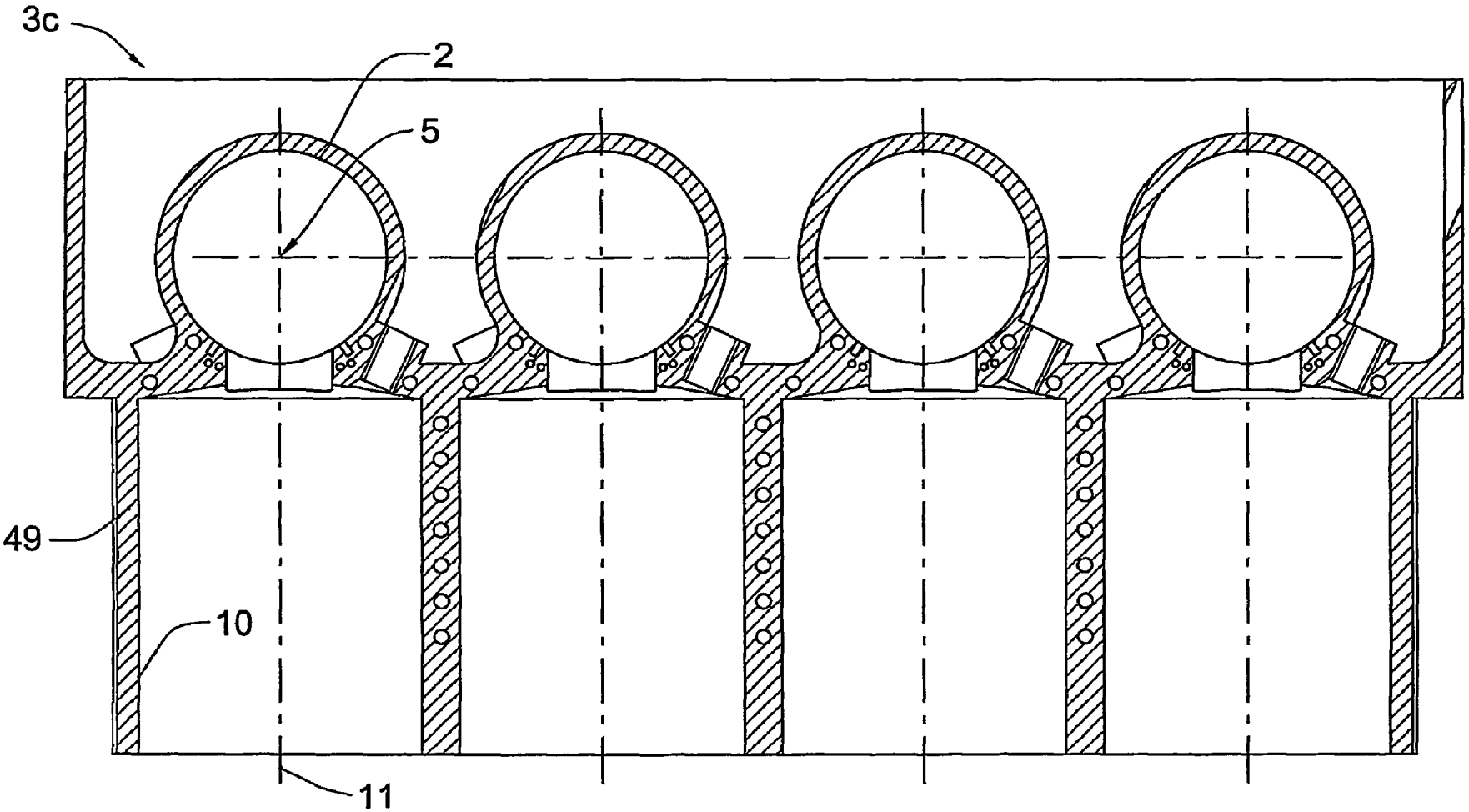
FIG. 10 is a sectional view through the cylinder head and integral cylinder liners of an axial flow rotary valve engine incorporating a fourth embodiment of the present invention, viewed in the same manner as FIG. 4.
Figure 11:
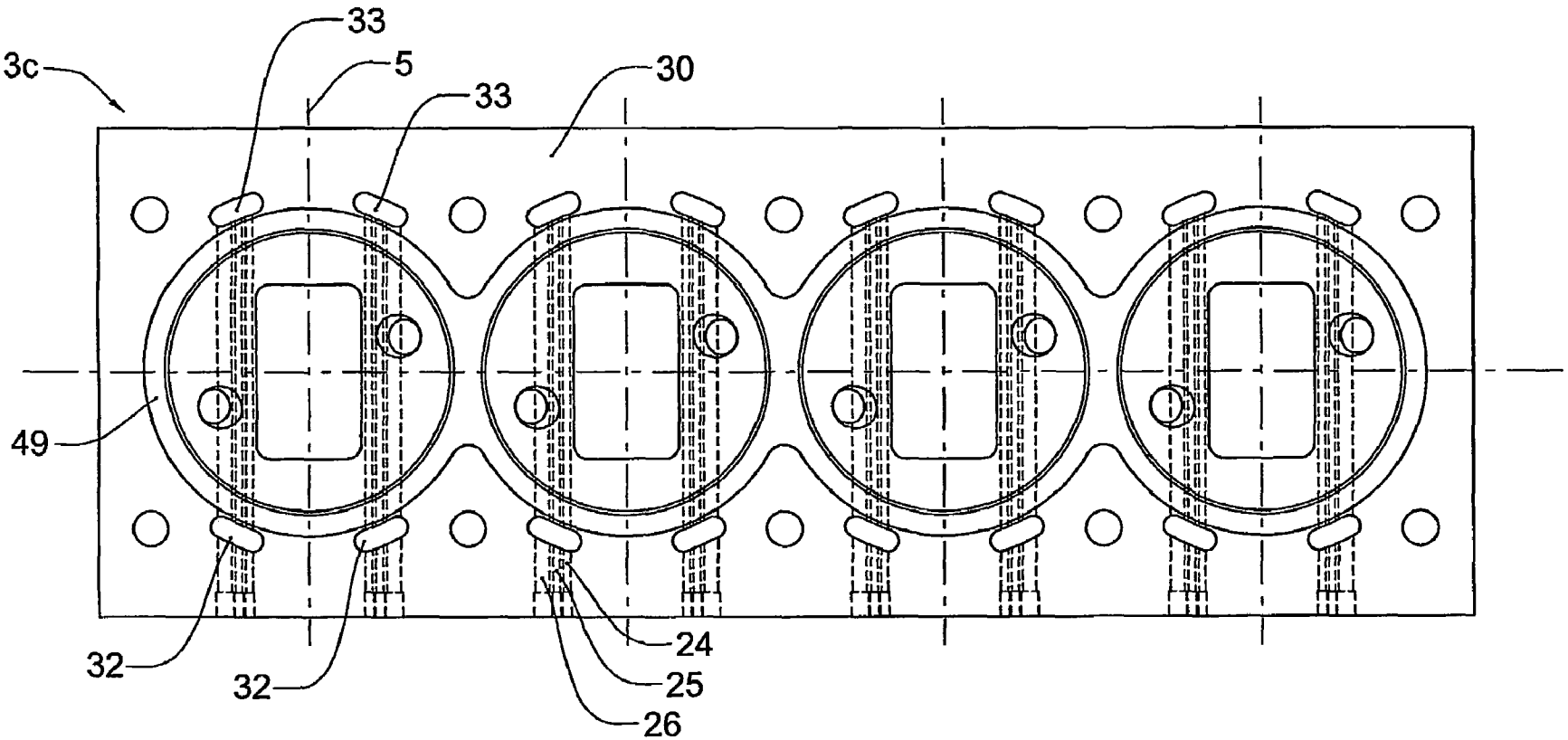
FIG. 11 shows the cylinder head of the engine of FIG. 10, viewed in the same manner as FIG. 3.
Figure 12:
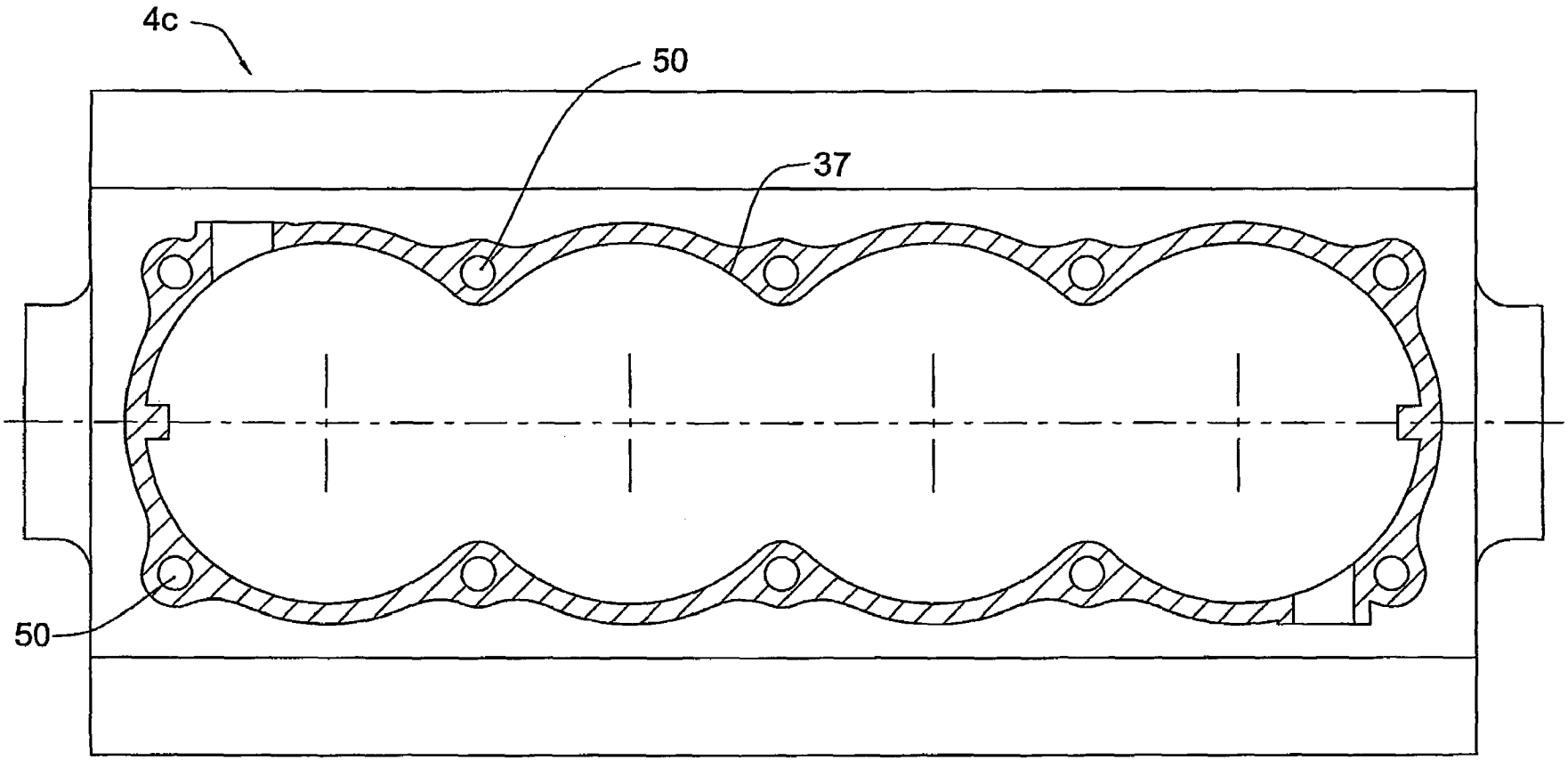
FIG. 12 is a sectional view through the cylinder block of the engine of FIG. 10, viewed in the same manner as FIG. 5.

FIGS. 10, 11 and 12 show an axial flow rotary valve engine incorporating a fourth embodiment of the present invention. In this embodiment, instead of being formed in the engine block, cylinders 10 are formed in cylinder liners 49 that are cast integral with cylinder head 3*c*. This is possible in a rotary valve engine because unlike a poppet valve engine, all machining of the combustion chamber can take place with the liner attached to the cylinder head. Referring to FIG. 11, cylinder head 3*c* is cooled in the same manner as the engine shown in FIGS. 1 to 5 with coolant entering head 3*c* through feed slots 32 in fireface 30 and exiting through exit slots 33.

The engine is assembled by bolting cylinder head 3*c* onto cylinder block 4*c*, using bolts secured in bolt housings 50, such that integral liners 49 extend into cylinder block 4*c*. Cylinder block 4*c* does not have any cast cooling passages. Instead its water jacket 37 is formed by the clearance between cylinder block 4*c* and integral liners 49. Water jacket 37 operates in the same manner as the engine shown in FIGS. 1 to 5 with restriction between both sides of the cylinders such that high and low pressure cooling channels are formed.

This arrangement has two very considerable advantages. Firstly, it eliminates the head gasket which is one of the most vulnerable elements in all combustion engines. Secondly, it allows the cylinder block 4*c* to be manufactured without a cast water jacket. Instead, as mentioned above, the water jacket is formed by the clearance between the cylinder block and the liners. This has the further advantage of allowing the width of the water jacket to be reduced to a minimum in contrast to cylinder blocks with conventional cast cooling passages where the width is determined by considerations of the strength of the sand core forming the cast water jacket. This allows a further reduction in the volume of coolant residing within the engine. The engine shown in FIGS. 10, 11 and 12 has no requirement for cast coolant passages in either the cylinder head or the cylinder block, which is a major simplification of the manufacturing process for internal combustion engines.

The term "comprising" as used herein is used in the inclusive sense of "including" or "having" and not in the exclusive sense of "consisting only of".

The invention claimed is:

1. A cylinder head for an axial flow rotary valve engine, said head comprising a bore having an axis and adapted to house an axial flow rotary valve, a window in said bore through which at least one port in said valve periodically communicates with a combustion chamber as said valve rotates, at least two axially extending slots in said bore, adjacent opposite sides of said window, each of said slots being adapted to locate a floating elongate gas sealing element, and at least one spark plug hole adjacent to said bore and adapted for mounting a spark plug associated with said valve, characterised in that said head further comprises at least one elongate axially extending cooling passage disposed between said bore and said spark plug hole, adjacent to one of said slots, said passage having a substantially constant cross section and extending axially at least over the length of said slots.

2. A cylinder head as claimed in claim 1 wherein said at least one passage comprises a plurality of passages surrounding each of said slots.

3. A cylinder head as claimed in claim 1 wherein said passage is circumferentially disposed between one of said slots and the adjacent side of said window.

4. A cylinder head as claimed in claim 1 wherein said cylinder head is manufactured from a casting and said passage is manufactured by a subsequent machining process.

5. A cylinder head as claimed in claim 4 wherein said casting does not include any cast cooling passages.

6. A cylinder head as claimed in claim 4 wherein said machining process comprises drilling.

7. A cylinder head as claimed in claim 4 wherein said machining process comprises electro-discharge machining.

8. A cylinder head as claimed in claim 1 wherein said cylinder head is integral with a cylinder liner.

9. A cylinder head as claimed in claim 1 wherein said passage has a substantially circular cross section.

10. A method of manufacturing a cylinder head for an axial flow rotary valve engine, said head comprising a bore having an axis and adapted to house an axial flow rotary valve, a window in said bore through which at least one port in said valve periodically communicates with a combustion chamber as said valve rotates, at least two axially extending slots in said bore, adjacent opposite sides of said window, each said slot being adapted to locate a floating elongate gas sealing element, and at least one spark plug hole adjacent to said bore and adapted for mounting a spark plug associated with said valve, characterised in that said cylinder head is manufactured from a casting and said method comprises machining at least one elongate axially extending cooling passage in said head, said passage being disposed between said bore and said spark plug hole, adjacent to one of said slots, said passage having a substantially constant cross section and extending axially at least over the length of said slots.

11. A method of manufacturing a cylinder head as claimed in claim 10 wherein said casting does not include any cast cooling passages.

12. A method of manufacturing a cylinder head as claimed in claim 10 wherein said machining process comprises drilling.

13. A method of manufacturing a cylinder head as claimed in claim 10 wherein said machining process comprises electro-discharge machining.

14. A method of manufacturing a cylinder head as claimed in claim 10 wherein said head is integral with a cylinder liner.

15. An axial flow rotary valve engine comprising at least one cylinder, a cylinder head, an axial flow rotary valve associated with each cylinder rotatable within a bore in said cylinder head about an axis, said axial flow rotary valve having an inlet port and an exhaust port periodically communicating with a combustion chamber through a window in said bore as said valve rotates, at least two axially extending slots in said bore, adjacent opposite sides of said window, each said slot housing a floating elongate gas sealing element, and at least one spark plug associated with said valve, each spark plug being mounted in a corresponding spark plug hole adjacent to said bore, characterised in that said head further comprises at least one elongate axially extending cooling passage disposed between said bore and said spark plug hole, adjacent to one of said slots, said passage having a substantially constant cross section and extending axially at least over the length of said slots, one end of said passage communicating with a high pressure cooling channel and the other end communicating with a low pressure cooling channel.

16. An axial flow rotary valve engine as claimed in claim 15 wherein said cylinder and said cooling channels are formed in a cylinder block, said high and low pressure channels being separated by flow restrictions in said cylinder block.

17. An axial flow rotary valve engine as claimed in claim 15 wherein said cylinder is formed in a cylinder liner that is integral with said cylinder head, and a cylinder block surrounds said cylinder liner, said cooling channels being formed by the clearances between said cylinder liner and said cylinder block, said high and low pressure cooling channels being separated by flow restrictions in said cylinder block.

18. An axial flow rotary valve engine as claimed in claim 15 wherein said engine further comprises a crankshaft and said at least one cylinder comprises at least two inline cylinders, the axis of each said axial flow rotary valve being substantially perpendicular to the axis of said crankshaft, said high pressure cooling channel being disposed on one side of said cylinders and said low pressure cooling channel being disposed on the opposite side of said cylinders.

19. An axial flow rotary valve engine as claimed in claim 15 wherein said at least one passage comprises a plurality of passages on each side of said window, surrounding said slots.

20. An axial flow rotary valve engine as claimed in claim 15 wherein said passage is circumferentially disposed between one of said slots and the adjacent side of said window.

21. An axial flow rotary valve engine as claimed in claim 15 wherein said at least one spark plug comprises two spark plugs adjacent opposite sides of said bore.

* * * * *